US008147038B2

(12) United States Patent
Yamanobe

(10) Patent No.: US 8,147,038 B2
(45) Date of Patent: Apr. 3, 2012

(54) IMAGE FORMING APPARATUS AND METHOD

(75) Inventor: Jun Yamanobe, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 12/627,867

(22) Filed: Nov. 30, 2009

(65) Prior Publication Data

US 2010/0073414 A1 Mar. 25, 2010

Related U.S. Application Data

(62) Division of application No. 11/714,869, filed on Mar. 7, 2007, now Pat. No. 7,766,442.

(30) Foreign Application Priority Data

Mar. 8, 2006 (JP) ..... 2006-063301

(51) Int. Cl.
*B41J 2/16* (2006.01)

(52) U.S. Cl. ..... 347/47; 347/14; 347/15

(58) Field of Classification Search ..... 347/5, 9, 347/14, 19, 47, 15
See application file for complete search history.

(56) References Cited

U.S. PATENT DOCUMENTS

| | | | |
|---|---|---|---|
| 6,846,066 | B2 | 1/2005 | Teshikawara et al. |
| 2004/0119766 | A1 | 6/2004 | Shibata et al. |
| 2004/0165021 | A1 | 8/2004 | Desie |
| 2006/0256157 | A1 | 11/2006 | Kim et al. |

FOREIGN PATENT DOCUMENTS

| | | | |
|---|---|---|---|
| JP | 2004-58284 | A | 2/2004 |
| JP | 2004-148723 | A | 5/2004 |
| JP | 2005-81679 | A | 3/2005 |
| JP | 2005-153435 | A | 6/2005 |

OTHER PUBLICATIONS

Japanese Office Action dated Apr. 27, 2011 for counterpart Japanese Application No. 2006-063301 with English translation.

*Primary Examiner* — Lam S Nguyen
(74) *Attorney, Agent, or Firm* — Birch, Stewart, Kolasch & Birch, LLP

(57) ABSTRACT

The image forming apparatus includes: a first group of large nozzles which eject large droplets of liquid for a color; a second group of small nozzles which eject small droplets of the liquid for the color, the small droplets having volume smaller than the large droplets; a dot data creation device which creates dot data according to input image data; a dot data correction device which corrects the dot data if there is an abnormal nozzle in one of the first and second groups, in such a manner that a corrective nozzle is selected from the other of the first and second groups, and droplet ejection performed by the corrective nozzle substitutes for droplet ejection that is originally to be performed by the abnormal nozzle; and a driving device which drives the large and small nozzles to eject the large and small droplets according to the corrected dot data.

8 Claims, 11 Drawing Sheets

| | CORRECTIVE NOZZLE(S) IF SMALL NOZZLE 22-3 IS IN EJECTION FAILURE STATE | CORRECTIVE NOZZLE(S) IF LARGE NOZZLE 12-3 IS IN EJECTION FAILURE STATE |
|---|---|---|
| $Pt*2/3 \leq \Delta Y$ | LARGE NOZZLE 12-2 | SMALL NOZZLE 22-4 |
| $Pt*1/3 < \Delta Y < Pt*2/3$ | LARGE NOZZLES 12-2, 12-3 | SMALL NOZZLES 22-3, 22-4 |
| $-Pt*1/3 \leq \Delta Y \leq Pt*1/3$ | LARGE NOZZLE 12-3 | SMALL NOZZLE 22-3 |
| $-Pt*2/3 < \Delta Y < -Pt*1/3$ | LARGE NOZZLES 12-3, 12-4 | SMALL NOZZLES 22-2, 22-3 |
| $\Delta Y \leq -Pt*2/3$ | LARGE NOZZLE 12-4 | SMALL NOZZLE 22-2 |

(ΔY: AMOUNT OF DISPLACEMENT BETWEEN LARGE NOZZLE ROW AND SMALL NOZZLE ROW
Pt: NOZZLE PITCH OF LARGE NOZZLE ROW AND SMALL NOZZLE ROW)

FIG.5

| | CORRECTIVE NOZZLE(S) IF SMALL NOZZLE 22-3 IS IN EJECTION FAILURE STATE | CORRECTIVE NOZZLE(S) IF LARGE NOZZLE 12-3 IS IN EJECTION FAILURE STATE |
|---|---|---|
| $Pt*2/3 \leqq \Delta Y$ | LARGE NOZZLE 12-2 | SMALL NOZZLE 22-4 |
| $Pt*1/3 < \Delta Y < Pt*2/3$ | LARGE NOZZLES 12-2, 12-3 | SMALL NOZZLES 22-3, 22-4 |
| $-Pt*1/3 \leqq \Delta Y \leqq Pt*1/3$ | LARGE NOZZLE 12-3 | SMALL NOZZLE 22-3 |
| $-Pt*2/3 < \Delta Y < -Pt*1/3$ | LARGE NOZZLES 12-3, 12-4 | SMALL NOZZLES 22-2, 22-3 |
| $\Delta Y \leqq -Pt*2/3$ | LARGE NOZZLE 12-4 | SMALL NOZZLE 22-2 |

($\Delta Y$: AMOUNT OF DISPLACEMENT BETWEEN LARGE NOZZLE ROW AND SMALL NOZZLE ROW
Pt: NOZZLE PITCH OF LARGE NOZZLE ROW AND SMALL NOZZLE ROW)

IMAGE FORMING APPARATUS AND METHOD

This application is a Divisional of application Ser. No. 11/714,869, filed on Mar. 7, 2007 now U.S. Pat. No. 7,766,442, which claims priority under 35 U.S.C. §119(a) to Patent Application No. 2006-063301 filed in Japan on Mar. 8, 2006, the entire contents of which are hereby incorporated by reference into the present application and for which priority is claimed under 35 U.S.C. §120.

BACKGROUND OF THE INVENTION

1. Field of the Invention

The present invention relates to an image forming apparatus and an image forming method, and more particularly, to an image forming apparatus having large nozzles and small nozzles which eject liquid droplets of different volumes for the same color.

2. Description of the Related Art

An inkjet recording apparatus is known that is provided with large nozzles and small nozzles for ejecting droplets of liquid or ink of the same color and mutually different volumes to be deposited onto a recording medium to form high-quality images having high tonal graduation. The large and small nozzles eject the large and small droplets at a prescribed ratio in accordance with the image to be recorded. In a thermal jet method, which performs ejection by using heating elements, a composition including large nozzles and small nozzles is particularly beneficial, since it is difficult to achieve satisfactory control of the ejection of liquid droplets having different volumes from the same nozzle, in comparison with a piezoelectric method using piezoelectric elements as actuators.

Banding (e.g., white stripes) may occur in the recorded image due to errors in the positions and the sizes of the dots formed on the recording medium by the liquid droplets ejected from the respective nozzles. As a method of reducing the visibility of banding, Japanese Patent Application Publication No. 2004-148723, for example, discloses a method for arranging the dot pattern in such a manner that large and small dots formed by droplets ejected from large nozzles and small nozzles do not overlap with each other. Moreover, Japanese Patent Application Publication No. 2005-153435 discloses a method according to which large nozzles and small nozzles are alternatively arranged so that the intervals between large dots are covered over by small dots without leaving any spaces. However, these methods cannot be expected to yield sufficient beneficial effects if, for example, there are nozzles suffering ejection failure due to nozzle blockages, or other causes.

Japanese Patent Application Publication No. 2004-58284, for example, discloses a method for reducing the visibility of banding caused by nozzles suffering ejection failure, in which recording data corresponding to a nozzle suffering ejection failure (ejection failure nozzle) is distributed to the recording data corresponding to the nozzles positioned adjacently to the ejection failure nozzle (adjacent nozzles). However, in this method, a burden is placed on the adjacent nozzles to which the recording data of the ejection failure nozzle is assigned, and the nozzle life is shortened. Furthermore, in this method, a droplet is simply ejected to form a dot at a position adjacent to the originally intended dot formation position of the ejection failure nozzle (i.e., the banding position), and no droplet is thereby deposited to form a dot directly at the banding position. Consequently, there are limitations on the reduction of the visibility of banding, and it is difficult to improve image quality further.

SUMMARY OF THE INVENTION

The present invention has been contrived in view of the foregoing circumstances, an object thereof being to provide an image forming apparatus and an image forming method whereby high-quality images can be formed by effectively reducing the visibility of banding caused by abnormal nozzles, while reducing concentration of load on particular nozzles.

In order to attain the aforementioned object, the present invention is directed to an image forming apparatus, comprising: a first group of large nozzles which eject large droplets of liquid for a color; a second group of small nozzles which eject small droplets of the liquid for the color, the small droplets having volume smaller than the large droplets; a dot data creation device which creates dot data according to input image data; a dot data correction device which corrects the dot data if there is an abnormal nozzle in one of the first and second groups, in such a manner that a corrective nozzle is selected from the other of the first and second groups, and droplet ejection performed by the corrective nozzle substitutes for droplet ejection that is originally to be performed by the abnormal nozzle; and a driving device which drives the large and small nozzles to eject the large and small droplets according to the corrected dot data.

According to this aspect of the present invention, if either one of the large nozzles or one of the small nozzles is an abnormal nozzle, then the dot data is corrected by using one of the other of the large nozzles and the small nozzles as a corrective nozzle, in such a manner that droplet ejection performed by the corrective nozzle substitutes for droplet ejection that is originally to be performed by the abnormal nozzle. Therefore, even in a region where the droplet ejection rate (the number of droplets ejected per unit surface area) of either the large nozzle or the small nozzle is high, a nozzle having a low droplet ejection rate is selected as the corrective nozzle. Consequently, it is possible to reduce the visibility of banding caused by the abnormal nozzle while reducing the concentration of load on a particular nozzle.

Here, the "abnormal nozzle" does not only means an ejection failure nozzle, which cannot eject a liquid droplet, but also includes a defective nozzle whose droplet depositing position, ejected droplet size, or the like, diverges significantly from the other nozzles.

Preferably, the large nozzles and the small nozzles are arranged in a first nozzle row and a second nozzle row, respectively, along a first direction; the driving device drives the large and small nozzles to eject the large and small droplets while moving the first and second nozzle rows relatively to a recording medium in a second direction perpendicular to the first direction; and the dot data correction device selects the corrective nozzle located at a position same with the abnormal nozzle with regard to the first direction.

This aspect of the present invention is suitable for cases where the first and second nozzle rows have the same nozzle pitch and the large nozzles and the small nozzles are arranged at the same positions in the first direction.

Alternatively, it is also preferable that the large nozzles and the small nozzles are arranged in a first nozzle row and a second nozzle row, respectively, along a first direction; the driving device drives the large and small nozzles to eject the large and small droplets while moving the first and second nozzle rows relatively to a recording medium in a second direction perpendicular to the first direction; and the dot data correction device selects the corrective nozzle located in a vicinity of the abnormal nozzle with regard to the first direction.

This aspect of the present invention is suitable for cases where the first and second nozzle rows have the same or different nozzle pitch and the large nozzles and the small nozzles are arranged at different positions in the first direction.

There is a mode where, of the nozzles belonging to the other nozzle row, the two nozzles adjacent on either side of the abnormal nozzle with regard to the first direction are used as corrective nozzles, and there is a mode where only one of these two nozzles is used as the corrective nozzle. In the latter case, desirably, the nozzle that is nearer to the abnormal nozzle is used as the corrective nozzle.

Preferably, the image forming apparatus further comprises: a nozzle row position calculation device which calculates an amount of relative displacement between the first nozzle row and the second nozzle row in the first direction, wherein the dot data correction device corrects the dot data while taking the calculated amount of the relative displacement into consideration.

According to this aspect of the present invention, it is possible to effectively reduce the visibility of banding caused by the abnormal nozzle, in accordance with the relative amount of displacement between the first and second nozzle rows.

Preferably, the dot data correction device corrects the dot data if the abnormal nozzle belongs to the second group, in such a manner that a total amount of the liquid ejected by the corrective nozzle is greater than a total amount of the liquid that is originally to be ejected by the abnormal nozzle.

According to this aspect of the present invention, it is possible to make the density at a banding position caused by the abnormal nozzle substantially the same with the density in a case where there is no abnormal nozzle.

Preferably, the dot data correction device corrects the dot data if the abnormal nozzle belongs to the first group, in such a manner that a total amount of the liquid ejected by the corrective nozzle is less than a total amount of the liquid that is originally to be ejected by the abnormal nozzle.

According to this aspect of the present invention, it is possible to make the density at a banding position caused by the abnormal nozzle substantially the same with the density in a case where there is no abnormal nozzle.

Preferably, the image forming apparatus further comprises an abnormal nozzle finding device which finds the abnormal nozzle.

In order to attain the aforementioned object, the present invention is also directed to an image forming method for an image forming apparatus having a first group of large nozzles and a second group of small nozzles, the large nozzles ejecting large droplets of liquid for a color, the small nozzles ejecting small droplets of the liquid for the color, the small droplets having volume smaller than the large droplets, the method comprising the steps of: creating dot data according to input image data; finding an abnormal nozzle in the large and small nozzles; correcting the dot data if the abnormal nozzle is found in one of the first and second groups, in such a manner that a corrective nozzle is selected from the other of the first and second groups, and droplet ejection performed by the corrective nozzle substitutes for droplet ejection that is originally to be performed by the abnormal nozzle; and driving the large and small nozzles to eject the large and small droplets according to the corrected dot data.

According to the present invention, if either a large nozzle or a small nozzle is an abnormal nozzle, then the dot data is corrected by using the other nozzle as a corrective nozzle, in such a manner that droplet ejection by the abnormal nozzle is replaced with droplet ejection by the corrective nozzle. Therefore, even in a region where the droplet ejection rate (the number of droplets ejected per unit surface area) of either the large nozzle or the small nozzle is high, a nozzle having a low droplet ejection rate is selected as the corrective nozzle. Consequently, it is possible to reduce the visibility of banding caused by an abnormal nozzle while reducing the concentration of load on a particular nozzle.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 5 is a diagram showing an embodiment of a correction table;

DETAILED DESCRIPTION OF THE PREFERRED EMBODIMENTS

Firstly, the characteristic features of the present invention are described, and then the overall composition of an inkjet recording apparatus forming an embodiment of the present invention is described.

Figure 1:
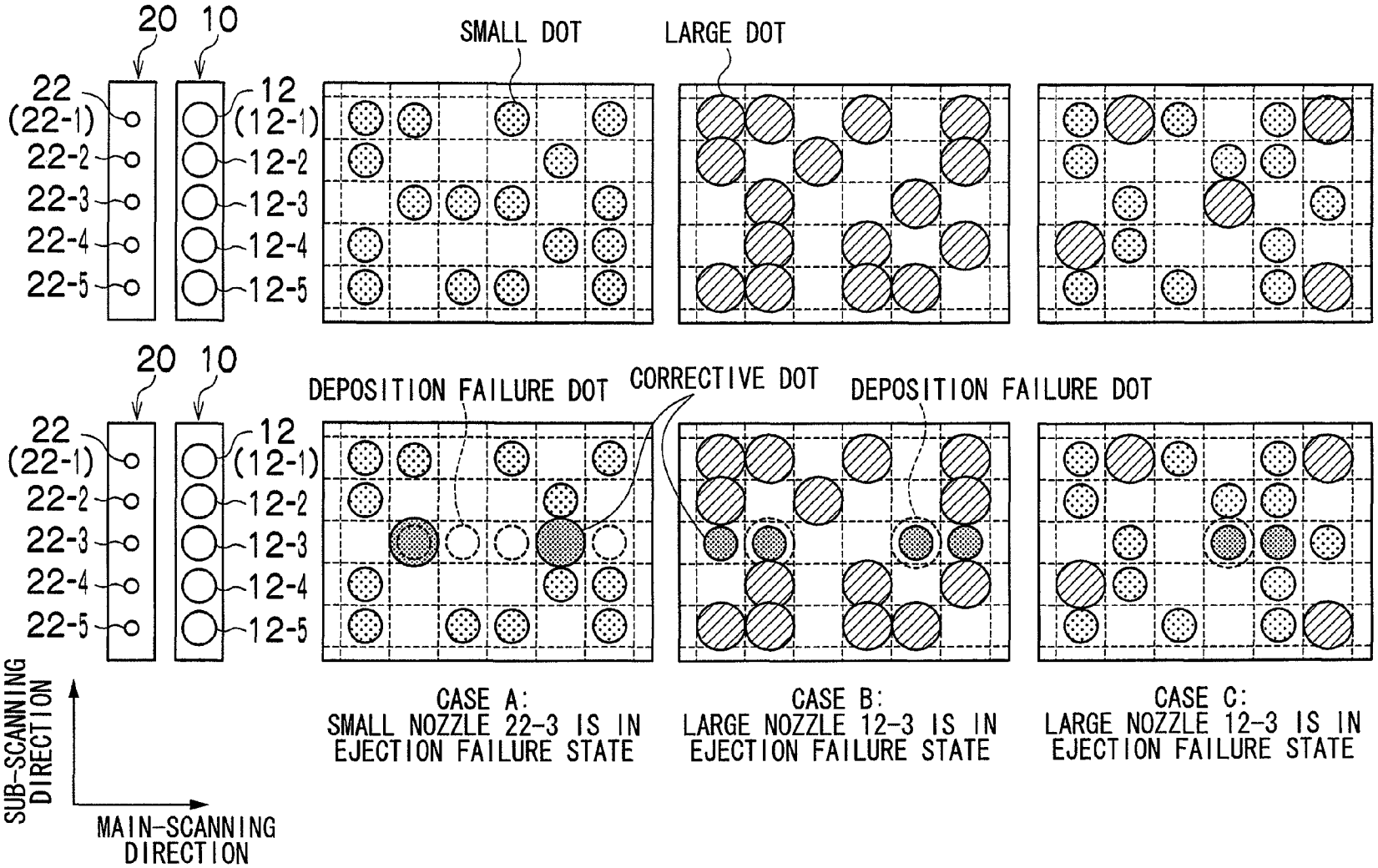
FIG. 1 is a diagram showing a first correction example according to an embodiment of the present invention.

As shown in the left-hand side in FIG. 1, the inkjet recording apparatus according to the present embodiment includes a large nozzle row (first nozzle row) 10 having large nozzles 12 for ejecting large droplets of liquid, arranged in a paper conveyance direction (sub-scanning direction), and a small nozzle row (second nozzle row) 20 having small nozzles 22 for ejecting small droplets of the liquid, arranged in the paper conveyance direction. The inkjet recording apparatus forms a desired image on a recording medium by ejecting liquid droplets of prescribed volumes from the large and small nozzles 12 and 22 toward the recording medium, while repeatedly scanning the recording medium with the nozzle rows 10 and 20 in a direction (main-scanning direction) perpendicular to the paper conveyance direction. In other words, an image is formed by means of a so-called shuttle recording system. Each pair of the nozzle rows 10 and 20 is provided for each of inks of colors (e.g., black (K), cyan (C), magenta (M) and yellow (Y)).

In the inkjet recording apparatus, dot data representing the dot formation positions and the dot sizes (ejection volumes of the droplets to form the dots) is created on the basis of the input image data, and the corresponding large nozzles 12 and small nozzles 22 eject droplets to form large dots and small dots, in accordance with this dot data. In this case, the formation rates of the large dots and the small dots (the number of dots formed on a unit surface area) are determined in accordance with density (ink volume density) of the recorded image.

One of the characteristic features of the present invention is that in the inkjet recording apparatus, if either a large nozzle 12 or a small nozzle 22 is in an abnormal state, then the other nozzle is taken as a corrective nozzle, and the dot data is corrected in such a manner that droplet ejection performed by the corrective nozzle substitutes for droplet ejection that is originally to be performed by the abnormal nozzle. Below, in order to simplify the description, a case is explained where the abnormal nozzle is a nozzle suffering an ejection failure (ejection failure nozzle), but the present invention can also be applied similarly to the case of defective nozzles.

In general, in a region toward which a large number of small droplets to form small dots are ejected (low-density region), the ejection rate of large droplets to form large dots is low, whereas in a region toward which a large number of large droplets to form large dots are ejected (high-density region), the ejection rate of small droplets to form small dots is low. Therefore, if a nozzle that ejects a liquid droplet of a different volume to the ejection failure nozzle is used as the corrective nozzle, then compared to a case where a nozzle that ejects a liquid droplet of the same volume with the ejection failure nozzle is used as the corrective nozzle, the load can be distributed rather than causing an extreme increase in the ejection rate of the particular nozzle, and therefore in overall terms, the nozzle lifespan can be prevented from shortening.

When thus correcting the dot data, since the dots formed by droplets ejected by a large nozzle 12 and a small nozzle 22 have different sizes (i.e., surface areas), it is then desirable that the difference in the size of the dots be taken into account. For example, in a case where a large nozzle 12 is in the ejection failure state, then if correction is carried out by substituting one small dot for one large dot, the density of the corrected portion becomes too low. On the other hand, in a case where a small nozzle 22 is in the ejection failure state, then if correction is carried out by substituting one large dot for one small dot, the density of the corrected portion becomes too high. In order to prevent effects of this kind, it is desirable that the difference in the size (surface area) of the dots formed by droplets ejected from the large nozzle 12 and the small nozzle 22 are taken into account in the correction process of the dot data. More specifically, if the volume of a liquid droplet ejected from a large nozzle 12 is x times the volume of a liquid droplet ejected from a small nozzle 22, it is then desirable that the dot data is corrected as described below:

(case 1) if a small nozzle is in the ejection failure state, then one large dot substitutes for y small dots; and (case 2) if a large nozzle is in the ejection failure state, then y small dots substitute for one large dot, where $y<x$.

This correction is desirable for the following reasons. In the case 1, if the total amount (total volume) of the liquid droplets ejected by the corrective nozzle (large nozzle) is made to be the same with the total amount of the liquid droplets that are originally to be ejected by the ejection failure nozzle (small nozzle), then although the amount of coloring material after correction becomes the same, the dot surface area after correction becomes smaller and hence the density of the corrected portion becomes lower, in comparison with the case where there is no ejection failure nozzle. Consequently, it is desirable to correct the dot data in such a manner that the total amount of the liquid droplets ejected by the corrective nozzle (large nozzle) is greater than the total amount of the liquid droplets that are originally to be ejected by the ejection failure nozzle (small nozzle), in other words, to replace y small dots with one large dot. Furthermore, in the case 2, if the total amount (total volume) of the liquid droplets ejected by the corrective nozzle (small nozzle) is made to be the same with the total amount of the liquid droplets that are originally to be ejected by the ejection failure nozzle (large nozzle), then although the amount of coloring material after correction becomes the same, the dot surface area after correction becomes greater and hence the density of the corrected portion becomes higher, in comparison with the case where there is no ejection failure nozzle. Consequently, it is desirable to correct the dot data in such a manner that the total amount of the liquid droplets ejected by the corrective nozzle (small nozzle) is less than the total amount of the liquid droplets that are originally to be ejected by the ejection failure nozzle (large nozzle), in other words, to replace one large dot with y small dots.

Next, the correction method according to the above-described embodiment of the present invention is explained with reference to specific correction examples (first to fourth correction examples). FIGS. 1 to 4 are diagrams for explaining the first to fourth correction examples, and the upper part and the lower part of each diagram show dot data before correction and dot data after correction, respectively. In the depiction of the dot data, a small dot is formed by a droplet ejected from a small nozzle 22 located in the same position with the small dot with regard to the sub-scanning direction, and a large dot is formed by a droplet ejected from a large nozzle 12 located in the same position with the large dot with regard to the sub-scanning direction. In the respective correction examples, correction is performed in a case where $x=3$ and $y=2$. Of course, the relationship between x and y is not limited to that of the present case.

FIG. 1 shows the first correction example, where the large and small nozzles are arranged in the nozzle rows 10 and 20 at the same nozzle pitch, and the large nozzles 12-*m* and the small nozzles 22-*m* (m=1, 2, 3, 4, 5) are arranged in the same position with regard to the sub-scanning direction.

As in the case A shown in FIG. 1, if the small nozzle 22-3 is in the ejection failure state, then the dot data is corrected in such a manner that the large nozzle 12-3 located at the same position with the ejection failure nozzle (small nozzle) 22-3 with regard to the sub-scanning direction serves as a corrective nozzle, and droplet ejection performed by the corrective nozzle (large nozzle) 12-3 substitutes for droplet ejection that is originally to be performed by the ejection failure nozzle (small nozzle) 22-3. In this case, the substitution is carried out at a ratio of one large dot to two small dots.

It is desirable that a large dot formed by a droplet ejected from the corrective nozzle is deposited onto either of the positions of the two small dots that are originally to be formed by droplets ejected from the ejection failure nozzle, or a position between these positions, with regard to the main-scanning direction.

As in the cases B and C shown in FIG. 1, if the large nozzle 12-3 is in the ejection failure state, then the dot data is corrected in such a manner that the small nozzle 22-3 located at the same position with the ejection failure nozzle (large nozzle) 12-3 with regard to the sub-scanning direction serves as a corrective nozzle, and droplet ejection performed by the corrective nozzle (small nozzle) 22-3 substitutes for droplet ejection that is originally to be performed by the ejection failure nozzle (large nozzle) 12-3. In this case, the substitution is carried out at a ratio of two small dots to one large dot.

It is desirable that a small dot formed by a droplet ejected from the corrective nozzle is deposited onto a position adjacent to, and more desirably, within one dot pitch of, the one large dot that is originally to be formed by a droplet ejected from the ejection failure nozzle, with regard to the main-scanning direction.

In the above-described cases where the large nozzle 12-*m* and the small nozzle 22-*m* are arranged at the same position in the sub-scanning direction, if one of the nozzles is in the ejection failure state, by taking the other nozzle as a corrective nozzle and correcting the dot data in such a manner that droplet ejection that is originally to be performed by the ejection failure nozzle is replaced with droplet ejection performed by the corrective nozzle, dots (corrective dots) are formed by droplets ejected from the corrective nozzle at positions (banding positions) where banding would occur due to the fact that no droplets are ejected to form dots (deposition failure dots) that are originally to be formed by the ejection failure nozzle. It is thus possible to effectively reduce the visibility of banding caused by the ejection failure nozzle.

Furthermore, in a region where, in the dot data prior to correction, the formation rate for dots originally formed by droplets ejected from the corrective nozzle is lower than the formation rate for dots that are originally to be formed by droplets ejected from the ejection failure nozzle, and in particular, in a low-density region or a high-density region where the formation rate for dots originally formed by droplets ejected from the corrective nozzle is 0%, as in the cases A and B shown in FIG. 1, then replacing droplet ejection in this way between nozzles that eject liquid droplets of different volumes is beneficial in that it allows the overall load to be distributed, rather than creating an extreme increase in the droplet ejection rate of the corrective nozzle, compared to a case where droplet ejection is replaced between nozzles that eject liquid droplets of the same volume.

Figure 2:
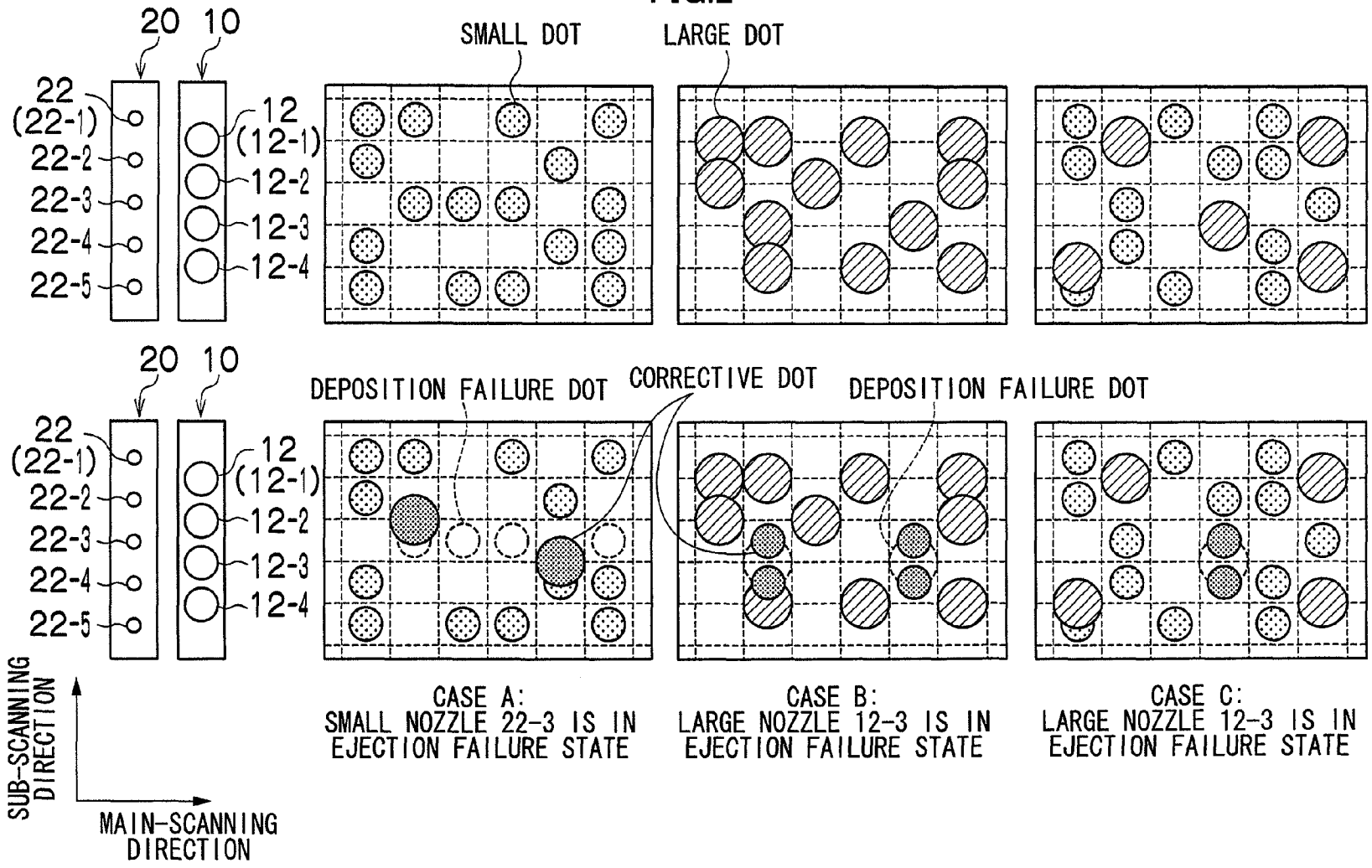
FIG. 2 is a diagram showing a second correction example.

FIG. 2 shows the second correction example, where the large and small nozzles are arranged in the nozzle rows 10 and 20 at the same nozzle pitch, and one nozzle row (the large nozzle row 10) is displaced by a half of the nozzle pitch in the sub-scanning direction with respect to the other nozzle row (small nozzle row 20), and the large nozzles 12 and the small nozzles 22 are arranged in a staggered configuration at alternating positions in the sub-scanning direction. This composition is especially valuable for achieving high resolution of dots in the sub-scanning direction, in a medium-density region where droplets are deposited to form a combination of large and small dots as in the case C in FIG. 2.

As in the case A shown in FIG. 2, if the small nozzle 22-3 is in the ejection failure state, then the dot data is corrected in such a manner that the large nozzles 12-2 and 12-3 located on sides of the ejection failure nozzle (small nozzle) 22-3 with regard to the sub-scanning direction serve as corrective nozzles, and droplet ejection performed by the corrective nozzles (large nozzles) 12-2 and 12-3 substitutes for droplet ejection that is originally to be performed by the ejection failure nozzle (small nozzle) 22-3. In this case, similarly to the first correction example, the substitution is carried out at a ratio of one large dot to two small dots. Moreover, the correction is desirably implemented in such a manner that the two corrective nozzles (large nozzles) 12-2 and 12-3 eject droplets to form dots (corrective dots) alternatively in the main-scanning direction, as shown in FIG. 2.

As in the cases B and C shown in FIG. 2, if the large nozzle 12-3 is in the ejection failure state, then the dot data is corrected in such a manner that the small nozzles 22-3 and 12-4 located on sides of the ejection failure nozzle (large nozzle) 12-3 with regard to the sub-scanning direction serve as corrective nozzles, and droplet ejection performed by the corrective nozzles (small nozzles) 22-3 and 22-4 substitutes for droplet ejection that is originally to be performed by the ejection failure nozzle (large nozzle) 12-3. In this case, the substitution is carried out at a ratio of two small dots to one large dot. Moreover, the correction is desirably implemented in such a manner that if no dots are originally formed by droplets ejected from the two corrective nozzles (small nozzles) 22-3 and 22-4 at the same position with the deposition failure dot with regard to the main-scanning direction as in the cases B and C in FIG. 2, then dots (corrective dots) are formed by droplets ejected from the corrective nozzles at the same position with the deposition failure dot with regard to the main-scanning direction.

Figure 3:
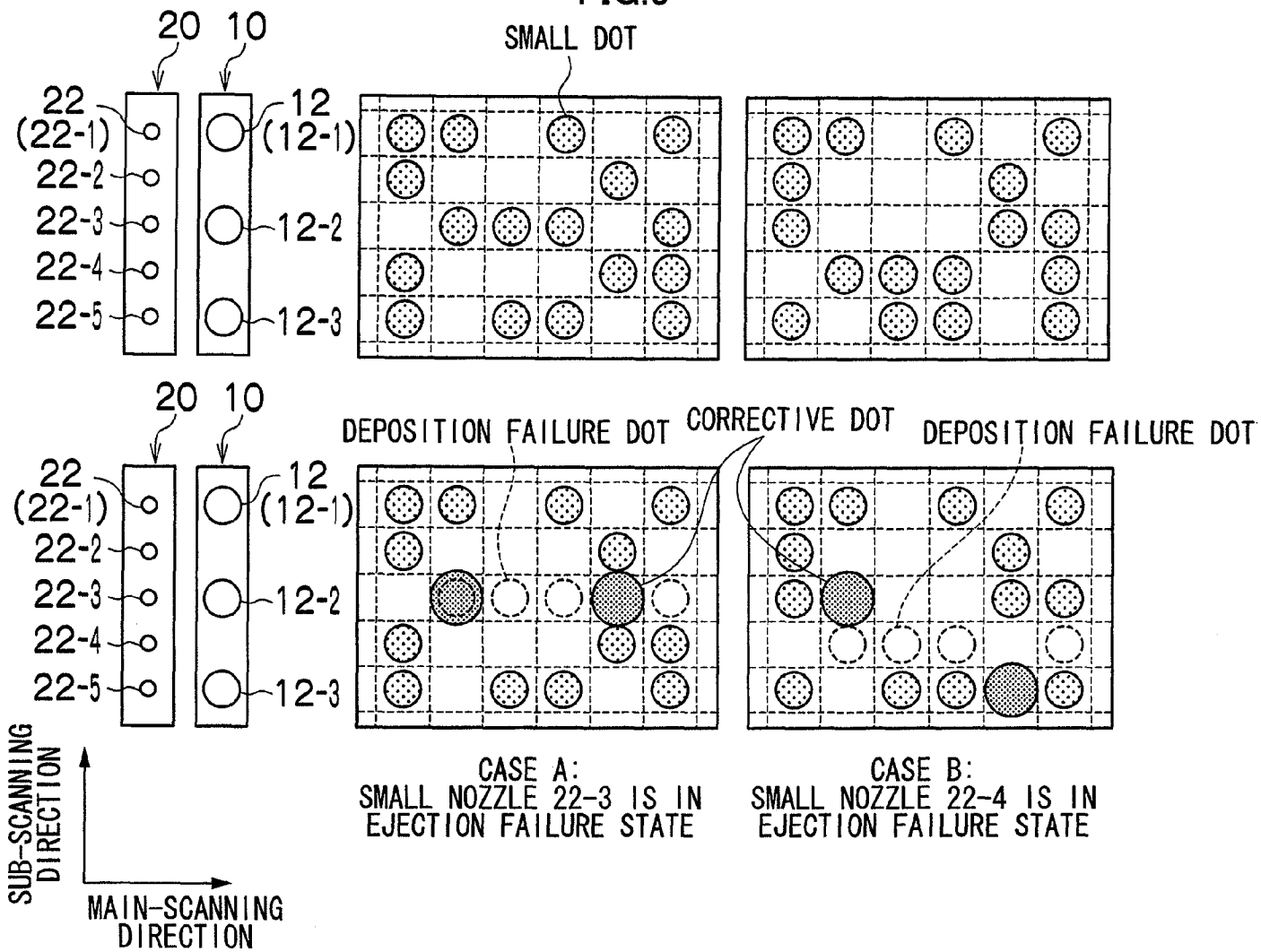
FIG. 3 is a diagram showing a third correction example.

FIG. 3 shows the third correction example, where the nozzle pitches of the large nozzle row 10 and the small nozzle row 20 are different to each other, and more specifically, the nozzle pitch of the small nozzle row 20 is a half of the nozzle pitch of the large nozzle row 10. In this composition, it is possible to reduce the number of large nozzles 12, and therefore a head having the large nozzle row 10 can be manufactured inexpensively.

As in the case A shown in FIG. 3, if the small nozzle 22-3 is in the ejection failure state, then the dot data is corrected in such a manner that the large nozzle 12-2 located at the same position with the ejection failure nozzle (small nozzle) 22-3 with regard to the sub-scanning direction serves as a corrective nozzle, and droplet ejection performed by the corrective nozzle (large nozzle) 12-2 substitutes for droplet ejection that is originally to be performed by the ejection failure nozzle (small nozzle) 22-3. In this case, similarly to the first correction example, the substitution is carried out at a ratio of one large dot to two small dots.

As in the case B shown in FIG. 3, if the small nozzle 22-4 is in the ejection failure state, correction similar to that of the second correction example (more specifically, the case A in FIG. 2) is carried out, since there is no large nozzle 12 located at the same position with the ejection failure nozzle (small nozzle) 22-4 with regard to the sub-scanning direction. More specifically, the dot data is corrected in such a manner that the large nozzles 12-2 and 12-3 located on sides of the ejection failure nozzle (small nozzle) 22-4 with regard to the sub-scanning direction serve as corrective nozzles, and droplet ejection performed by the corrective nozzles (large nozzles) 12-2 and 12-3 substitutes for droplet ejection that is originally to be performed by the ejection failure nozzle (small nozzle) 22-4. In this case, similarly to the first correction example, the substitution is carried out at a ratio of one large dot to two small dots. Moreover, the correction is desirably implemented in such a manner that the two corrective nozzles (large nozzles) 12-2 and 12-3 eject droplets to form dots (corrective dots) alternatively in the main-scanning direction, as shown in FIG. 3.

As described above, the third correction example corresponds to a combination of the first correction example and the second correction example. If one of the large nozzles 12 is in the ejection failure state, then similarly to the first correction example (more specifically, the cases B and C in FIG. 1), the dot data is corrected in such a manner that the small nozzle 22 located at the same position with the ejection failure nozzle (large nozzle) 12 with regard to the sub-scanning direction serves as a corrective nozzle.

Figure 4:
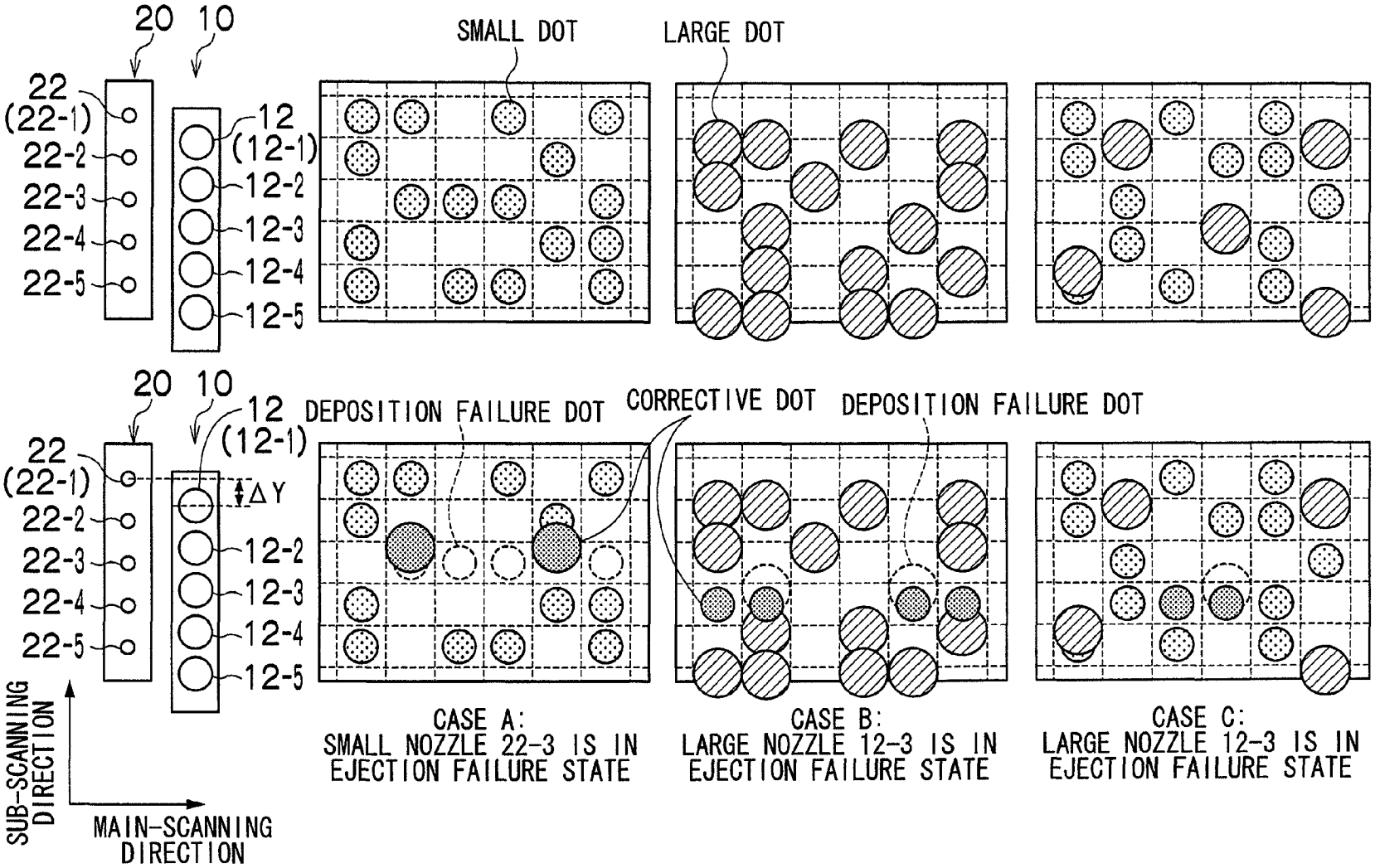
FIG. 4 is a diagram showing a fourth correction example.

FIG. 4 shows the fourth correction example, where the large and small nozzles are arranged in the nozzle rows 10 and 20 at the same nozzle pitch, but one of the nozzle rows (the large nozzle row 10) is displaced by a prescribed amount ΔY in the sub-scanning direction with respect to the other nozzle row (the small nozzle row 20). This displacement in position between the nozzle rows can be ascertained from the information obtained by a print determination unit 124 described below (see FIG. 11).

As in the case A shown in FIG. 4, if the small nozzle 22-3 is in the ejection failure state, then the dot data is corrected in such a manner that the large nozzle 12-2 located at the nearest position to the ejection failure nozzle (small nozzle) 22-3 with regard to the sub-scanning direction serves as a corrective nozzle, and droplet ejection performed by the corrective nozzle (large nozzle) 12-2 substitutes for droplet ejection that is originally to be performed by the ejection failure nozzle (small nozzle) 22-3. In this case, similarly to the first correction example, the substitution is carried out at a ratio of one large dot to two small dots. If the large nozzles 12-2 and 12-3 positioned on sides of the ejection failure nozzle (small nozzle) 22-3 are located equidistantly from the ejection failure nozzle (small nozzle) 22-3, then similar correction to that of the second correction example (more specifically, the case A in FIG. 2) is carried out.

As in the cases B and C shown in FIG. 4, if the large nozzle 12-3 is in the ejection failure state, then the dot data is corrected in such a manner that the small nozzle 22-4 located at the nearest position to the ejection failure nozzle (large nozzle) 12-3 with regard to the sub-scanning direction serves as a corrective nozzle, and droplet ejection performed by the corrective nozzle (small nozzle) 22-4 substitutes for droplet ejection that is originally to be performed by the ejection failure nozzle (large nozzle) 12-3. In this case, similarly to the first correction example, the substitution is carried out at a ratio of two small dots to one large dot. If the small nozzles 22-3 and 22-4 positioned on sides of the ejection failure nozzle (large nozzle) 12-3 are located equidistantly from the ejection failure nozzle (large nozzle) 12-3, then similar correction to that of the second correction example (more specifically, the cases B and C in FIG. 2) is carried out.

Furthermore, it is also possible to select a corrective nozzle in accordance with a correction table prepared beforehand, depending on the amount of displacement ΔY between the nozzle rows. FIG. 5 shows an embodiment of the correction table. This correction table shows the corrective nozzle(s) selected when the small nozzle 22-3 or the large nozzle 12-3 is in the ejection failure state, depending on the amount of displacement ΔY between the nozzle rows. For example, in a case where the amount of displacement ΔY between the nozzle rows is equal to or greater than ⅔ of the nozzle pitch Pt, if the small nozzle 22-3 is in the ejection failure state, then the large nozzle 12-2 is selected as a corrective nozzle, and if the large nozzle 12-3 is in the ejection failure state, then the small nozzle 22-4 is selected as a corrective nozzle. Thus, it is possible to achieve satisfactory correction even in cases where the large nozzle row 10 and the small nozzle row 20 are installed in a mutually displaced fashion in the sub-scanning direction. In the present embodiment, if the large nozzle **12-*m* approaches the small nozzle 22-(*m*+1)** in the sub-scanning direction through the displacement, the amount of displacement ΔY is then regarded as positive (i.e., $\Delta Y>0$).

Figure 6:
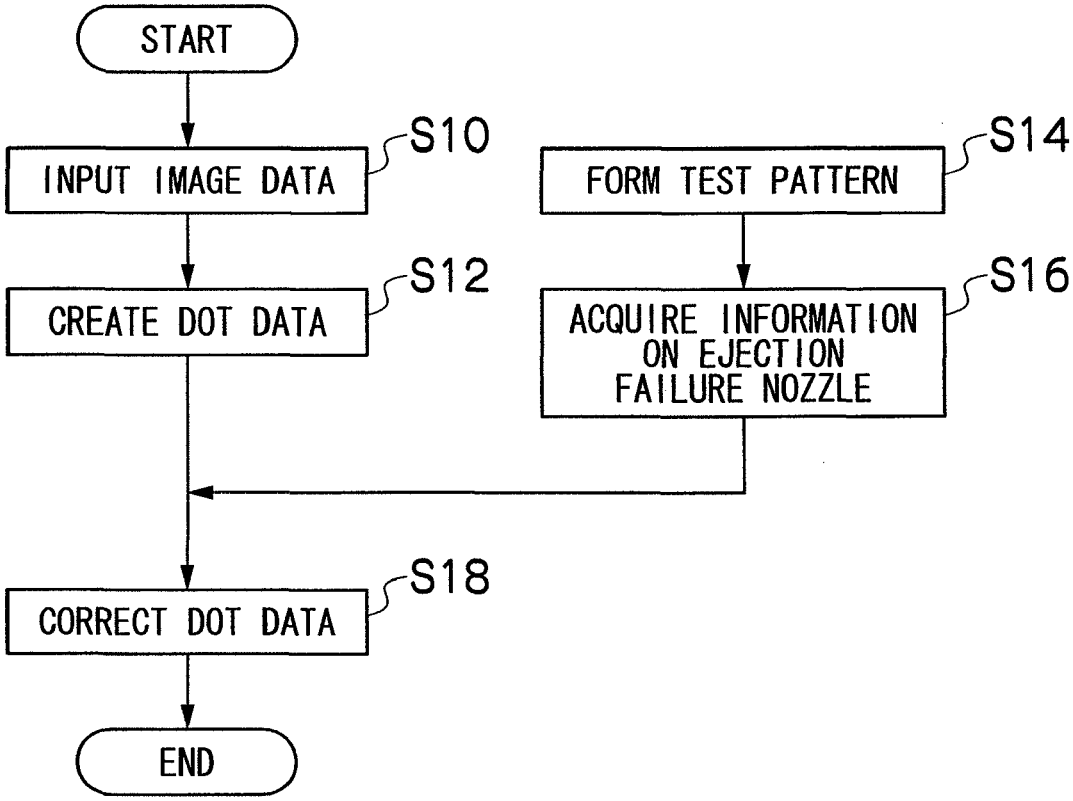
FIG. 6 is a flowchart showing the overall sequence of correction of the dot data.

Next, the overall sequence of the correction of dot data carried out by the inkjet recording apparatus according to the present embodiment is described with reference to the flowchart shown in FIG. 6.

Firstly, image data is inputted from an external apparatus, such as a host computer 186 (see FIG. 11) (step S10). Thereupon, dot data (output image data) is created by a commonly known image processing means, on the basis of the input image data (step S12). The dot data indicates the positions of the dots to be formed by droplets ejected from the nozzles 12 and 22.

On the other hand, a test pattern is formed on a recording medium by ejecting droplets to form dots from the nozzles 12 and 22 (step S14), and information relating to the presence or absence of an ejection failure nozzle (ejection failure nozzle information) is acquired through the test pattern (step S16). The ejection failure nozzle information includes information indicating whether or not there is an ejection failure nozzle in the large and small nozzle rows 10 and 20, and if there is an ejection failure nozzle, information indicating the position of the ejection failure nozzle (for example, the nozzle number).

Figure 7:
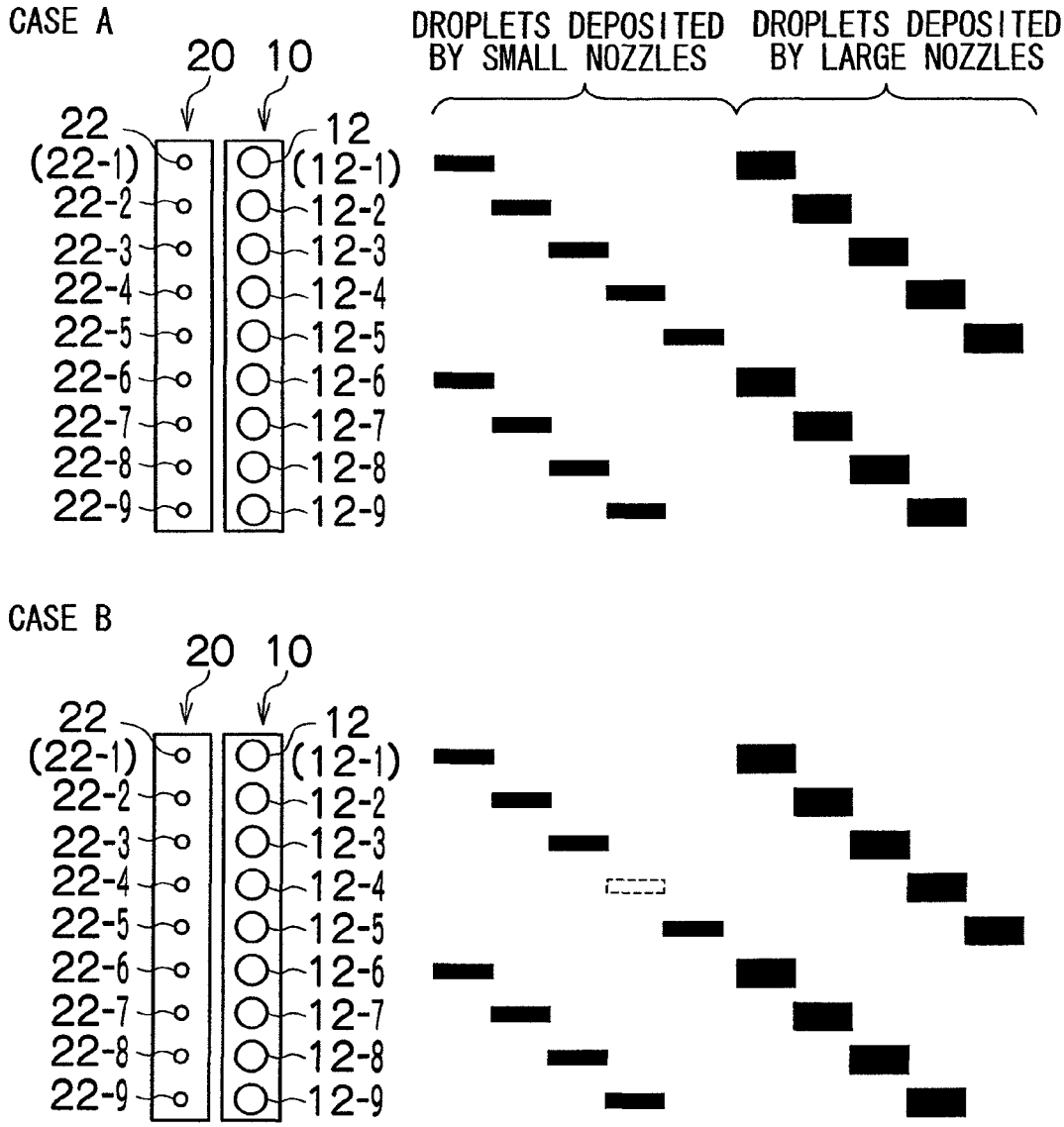
FIG. 7 is a diagram showing examples of a test pattern.

FIG. 7 shows examples of the test pattern. As in the case A shown in FIG. 7, this test pattern is formed by ejecting droplets continuously (or non-continuously) from the nozzles 12 and 22 to form a plurality of dots, in a prescribed sequence, while moving the large and small nozzle rows 10 and 20 relatively to the recording medium in the main-scanning direction. As in the case B shown in FIG. 7, if the small nozzle 22-4 is in the ejection failure state, then no dots are formed at a position (indicated by dotted lines in FIG. 7) where dots are originally formed by droplets ejected from the ejection failure nozzle (small nozzle) 22-4, and it is possible to find the ejection failure nozzle by reading in the test pattern, either visually or by means of a scanner, or the like.

There is no particular restriction on the timing at which the ejection failure nozzle information is acquired, and it may be acquired when the power supply to the inkjet recording apparatus is switched on, or during execution of a job. Moreover, a mode is also possible in which the user can input ejection failure nozzle information to the inkjet recording apparatus if the user judges that banding has occurred, on the basis of a visual inspection.

According to the ejection failure nozzle information thus acquired, the dot data is corrected in any of the above-described methods (step S18). Thereupon, according to the thus corrected dot data, droplets are ejected from the large and small nozzles 12 and 22 to form large dots and small dots.

The correction method according to the embodiment of the present invention is not only applicable to cases where there is an ejection failure nozzle, which is not capable of ejecting liquid droplets, and it is also applicable to other cases where there is a defective nozzle that is not capable of normally ejecting droplets and whose droplet depositing position, ejected droplet size, or the like, significantly diverges from the other nozzles, for various reasons. The embodiment of the present invention can easily be applied to cases such as this, by treating the defective nozzle as an ejection failure nozzle in the correction methods described above.

Figure 8:
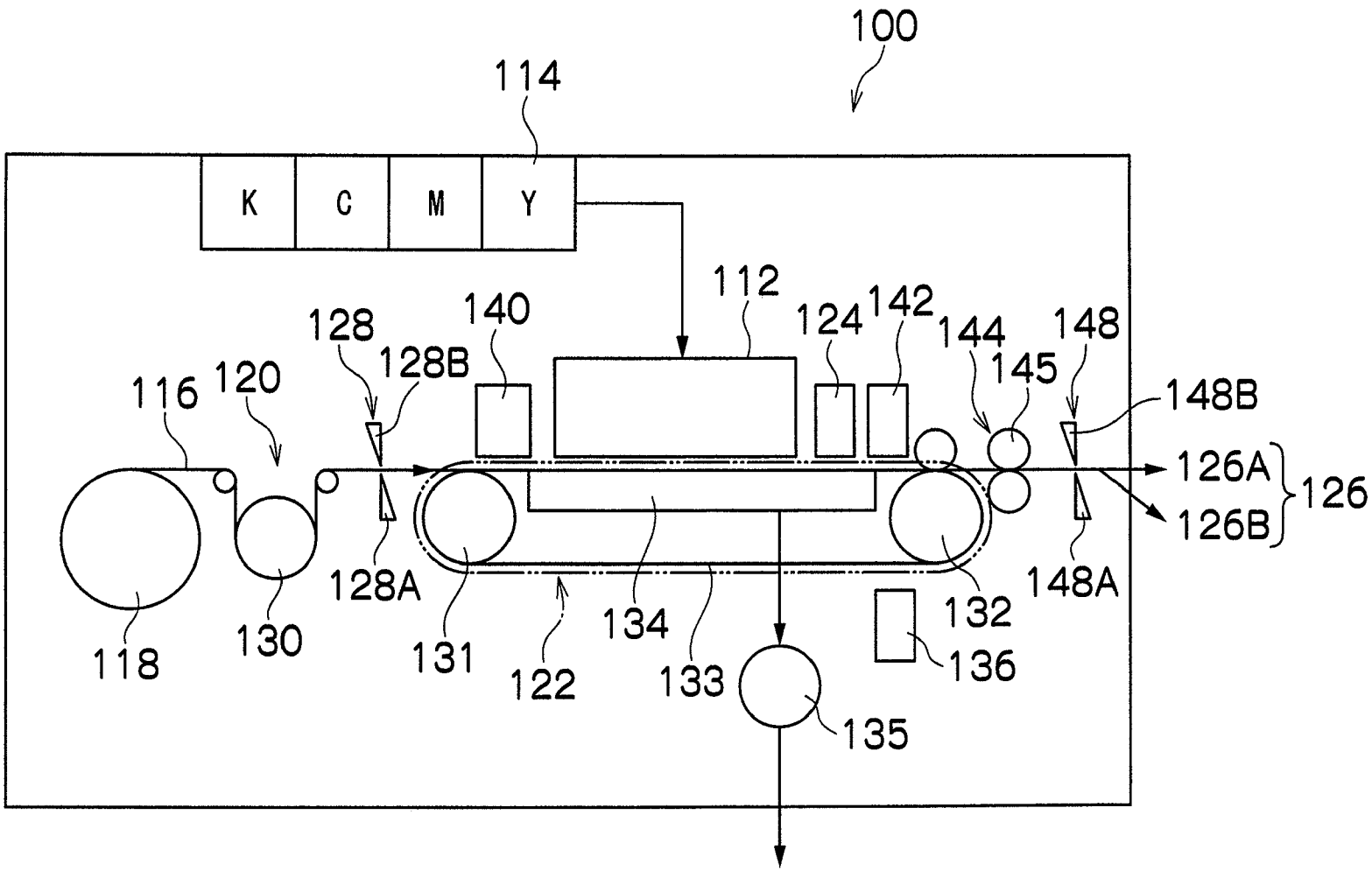
FIG. 8 is a schematic diagram of an inkjet recording apparatus forming an embodiment of the present invention.

Next, the general composition of an inkjet recording apparatus serving as the image forming apparatus according to an embodiment of the present invention is described. FIG. 8 is a general schematic drawing of the inkjet recording apparatus according to the present embodiment. As shown in FIG. 8, the inkjet recording apparatus 100 comprises: a print unit 112 for ejecting inks of the respective colors of black (K), cyan (C), magenta (M), and yellow (Y); an ink storing and loading unit 114 for storing inks to be supplied to the print unit 112; a paper supply unit 118 for supplying recording paper 116; a decurling unit 120 for removing curl in the recording paper 116; a suction belt conveyance unit 122 disposed facing the ink ejection surfaces (nozzle surfaces) of the print unit 112, for conveying the recording paper 116 while keeping the recording paper 116 flat; a print determination unit 124 for reading the printed result produced by the print unit 112; and a paper output unit 126 for outputting image-printed recording paper (printed matter) to the exterior.

In FIG. 8, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 128 is provided as shown in FIG. 8, and the roll paper is cut to a desired size by the cutter 128. The cutter 128 has a stationary blade 128A, whose length is not less than the width of the conveyor pathway of the recording paper 116, and a round blade 128B, which moves along the stationary blade 128A. The stationary blade 128A is disposed on the reverse side of the printed surface of the recording paper 116, and the round blade 128B is disposed on the printed surface side across the conveyance path. When cut paper is used, the cutter 128 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

The decurled and cut recording paper 116 is delivered to the suction belt conveyance unit 122. The suction belt conveyance unit 122 has a configuration in which an endless belt 133 is set around rollers 131, 132 so that the portion of the endless belt 133 facing at least the ink ejection surface of the print unit 112 and the sensor surface of the print determination unit 124 forms a plane.

The belt 133 has a width that is greater than the width of the recording paper 116, and a plurality of suction apertures (not shown) are formed on the belt surface. A suction chamber 134 is disposed in a position facing the sensor surface of the print determination unit 124 and the ink ejection surface of the print unit 112 on the interior side of the belt 133, which is set around the rollers 131, 132, as shown in FIG. 8. The suction chamber 134 provides suction with a fan 135 to generate a negative pressure, and the recording paper 116 on the belt 133 is held by suction.

The belt 133 is driven in the clockwise direction in FIG. 8 by the motive force of a motor (not shown in drawings) being transmitted to at least one of the rollers 131, 132, which the belt 133 is set around, and the recording paper 116 held on the belt 133 is conveyed in a sub-scanning direction, which is a paper conveyance direction (rightward direction in FIG. 8).

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, embodiments thereof include a configuration in which the belt 133 is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different than that of the belt 133 to improve the cleaning effect.

The inkjet recording apparatus can comprise a roller nip conveyance mechanism, instead of the suction belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the print unit 112 in the conveyance pathway formed by the suction belt conveyance unit 122. The heating fan 140 blows heated air onto the recording paper 116 to heat the recording paper 116 immediately before printing so that the ink deposited on the recording paper 116 dries more easily.

The ink storing and loading unit 114 has a tank for storing inks of respective colors (K, C, M, Y) to be supplied to the print unit 112, and each tank is connected to the print unit 112 by means of a tubing channel (not shown). Moreover, the ink storing and loading unit 114 also comprises a notifying device (display device, alarm generating device, or the like) for generating a notification if the remaining amount of ink has become low, as well as having a mechanism for preventing incorrect loading of ink of the wrong color.

The print determination unit 124 has an image sensor (line sensor) for capturing an image of the ink-droplet deposition result of the print unit 112, and functions as a device to check for ejection defects such as clogs of the nozzles from the ink-droplet deposition results evaluated by the image sensor.

The print determination unit 124 of the present embodiment is configured with a line sensor having rows of photoelectric transducing elements with a width that is greater than the image recording width of the recording paper 116. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 124 reads in the test pattern printed by the print unit 112 and determines the ejection performed by the print unit 112. The ejection determination includes determination of the presence of the dots, measurement of the dot sizes, measurement of the dot deposition positions, and the like.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 100, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. The cutter 148 is disposed directly in front of the paper output unit 126, and is used for cutting the test print portion from the target print portion when a test print has been performed in the blank portion of the target print. The structure of the cutter 148 is the same with the first cutter 128 described above, and has a stationary blade 148A and a round blade 148B. Although not shown in the drawing, the paper output unit 126A for the target prints is provided with a sorter for collecting images according to print orders.

Figure 9:
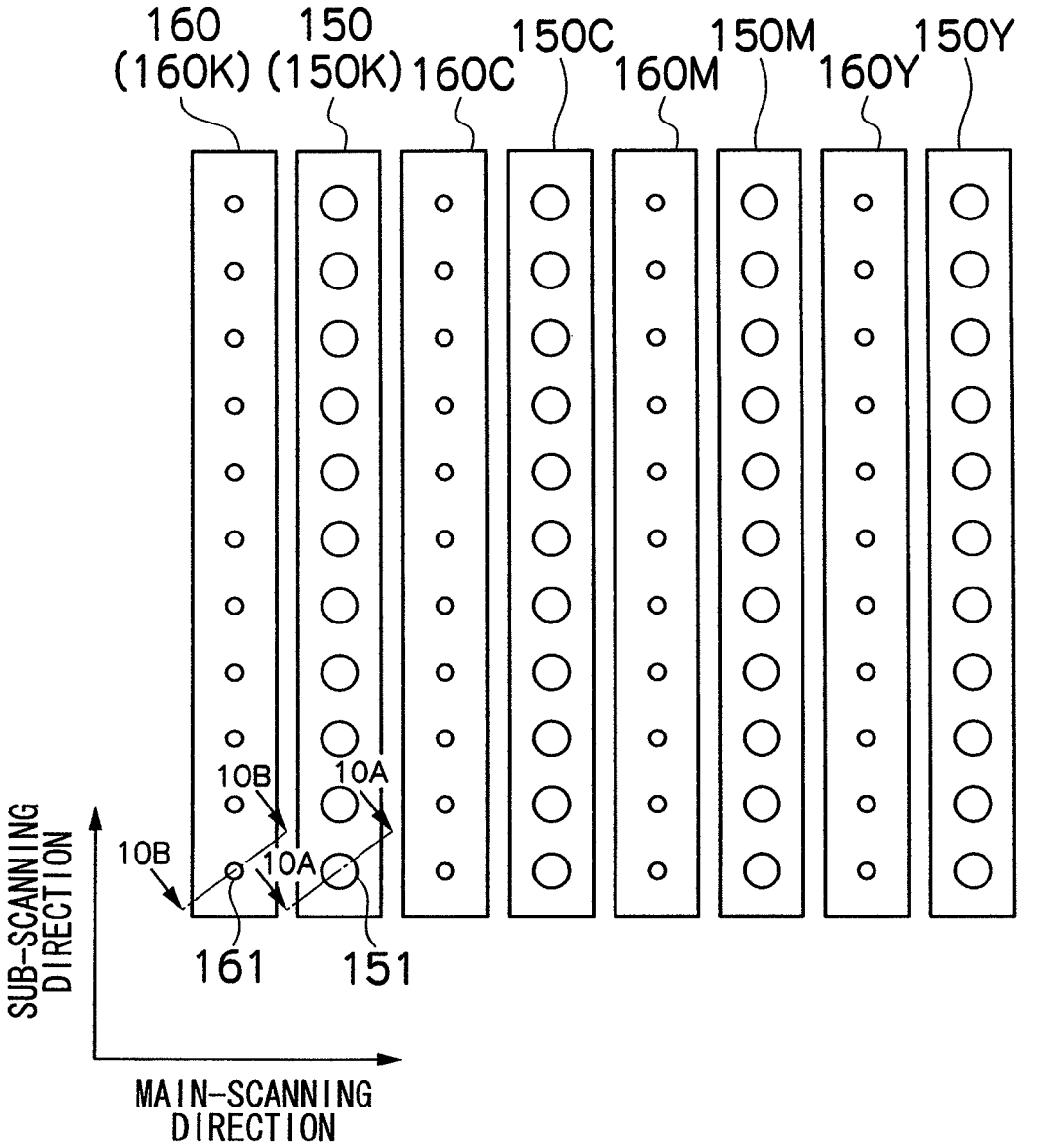
FIG. 9 is a plan diagram showing an ink ejection surface of a print unit.

FIG. 9 is a plan diagram showing the ink ejection surface of the print unit 112. As shown in FIG. 9, the print unit 112 is provided with first heads 150 (150K, 150C, 150M, 150Y) and second heads 160 (160K, 160C, 160M, 160Y) in correspondence with the inks of the respective colors, black (K), cyan (C), magenta (M) and yellow (Y).

In each of the first heads 150, a plurality of large nozzles 151 for ejecting large droplets are arranged following the sub-scanning direction, and each of the large nozzles 151 ejects a large droplet of the corresponding colored ink (K, C, M or Y). In each of the second heads 160, a plurality of small nozzles 161 for ejecting small droplets are arranged following the sub-scanning direction, and each of the small nozzles 161 ejects a small droplet of the corresponding colored ink (K, C, M or Y). The nozzle pitches of the first head 150 and the second head 160 are the same, and the large nozzles 151 and the small nozzles 161 are arranged at the same positions to each other in the sub-scanning direction. The nozzle arrangement in the present embodiment corresponds to the nozzle arrangement described with reference to FIG. 1, but there are also modes where nozzle arrangements corresponding to the nozzle arrangements described with reference to FIGS. 2 to 4 are adopted.

Figure 10A:
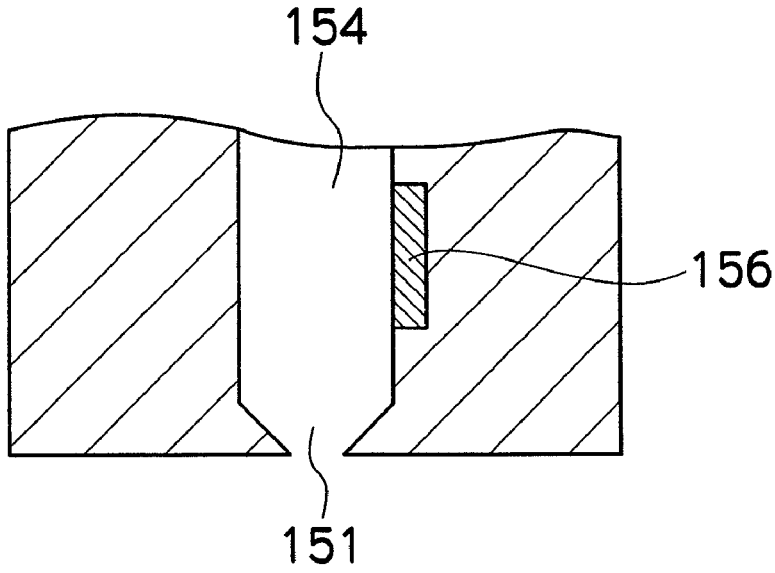
FIGS. 10A and 10B are partial cross-sectional diagrams showing the internal composition of first and second heads, respectively.
Figure 10B:
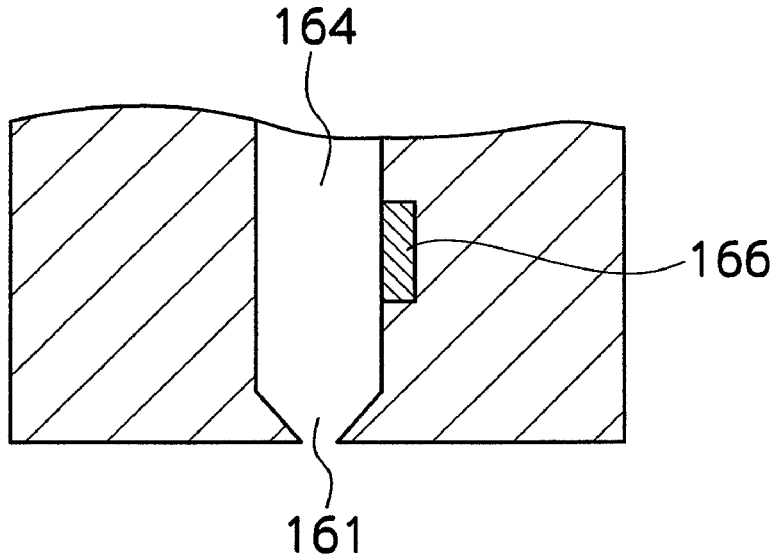

FIGS. 10A and 10B are partial cross-sectional diagrams showing the internal composition of the heads, where FIG. 10A is a cross-sectional diagram of the first head 150 along line 10A-10A in FIG. 9, and FIG. 10B is a cross-sectional diagram of the second head 160 along line 10B-10B in FIG. 9.

As shown in FIG. 10A, each large nozzle 151 is connected to an individual flow channel 154 inside the first head 150. The individual flow channels 154 are provided correspondingly to the large nozzles 151, and are connected to a common flow channel (not shown). Ink of the prescribed color (K, C, M or Y) is supplied from the ink storing and loading unit 114 shown in FIG. 8 to the individual flow channels 154 through the common flow channel. A heating element 156, such as a heater, is arranged on the inner wall of each individual flow channel 154. By applying a prescribed drive voltage to the heating element 156 from a drive circuit (not shown), the ink inside the individual flow channel 154 is heated, thereby generating a bubble, and a large droplet is ejected from the large nozzle 151 due to the pressure created by this bubble.

As shown in FIG. 10B, the second head 160 has the internal structure similar to that of the first head 150, and is provided with individual flow channels 164 connected respectively to the small nozzles 161, and heating elements 166. A small droplet is ejected from the small nozzle 161.

The heads 150 and 160 having the above-described composition are mounted in a carriage (not shown), and a desired image is recorded on the recording paper 116 by ejecting differently sized liquid droplets of the corresponding colored inks from the heads 150 and 160, while moving the heads 150 and 160 alternately forward and backward in the main-scanning direction, which is perpendicular to the sub-scanning direction, and conveying the recording paper 116 in the sub-scanning direction (paper feed direction).

In the present embodiment, each of the heads 150 and 160 has a single nozzle row aligned in the sub-scanning direction, but the implementation of the present invention is not limited to this, and a mode is also possible in which each of the heads 150 and 160 has a plurality of nozzle rows. Moreover, it is also possible to adopt a mode in which each nozzle row is composed of large and small nozzles, by, for instance, alternatively arranging the large nozzles 151 and the small nozzles 161. Further, the invention is not limited to the mode where the heads are provided correspondingly for the nozzle rows, as in the present embodiment, and it is also possible to adopt a mode in which heads are provided correspondingly for colors of ink, or a mode where all of the nozzle rows are arranged in a single head.

Furthermore, the present embodiment is described with respect to the shuttle type of inkjet recording apparatus, which performs recording by moving the nozzle rows that are arranged in the paper feed direction (sub-scanning direction) alternately forward and backward in the main-scanning direction, but the implementation of the present invention is not limited to this. For example, it is also possible to use a line type of inkjet recording apparatus, which has a line head formed with a plurality of large nozzles and small nozzles covering the maximum recordable width of the recording medium, and performs recording by moving this line head in the sub-scanning direction relatively to the recording medium.

Next, the control system of the inkjet recording apparatus 100 is described.

Figure 11:
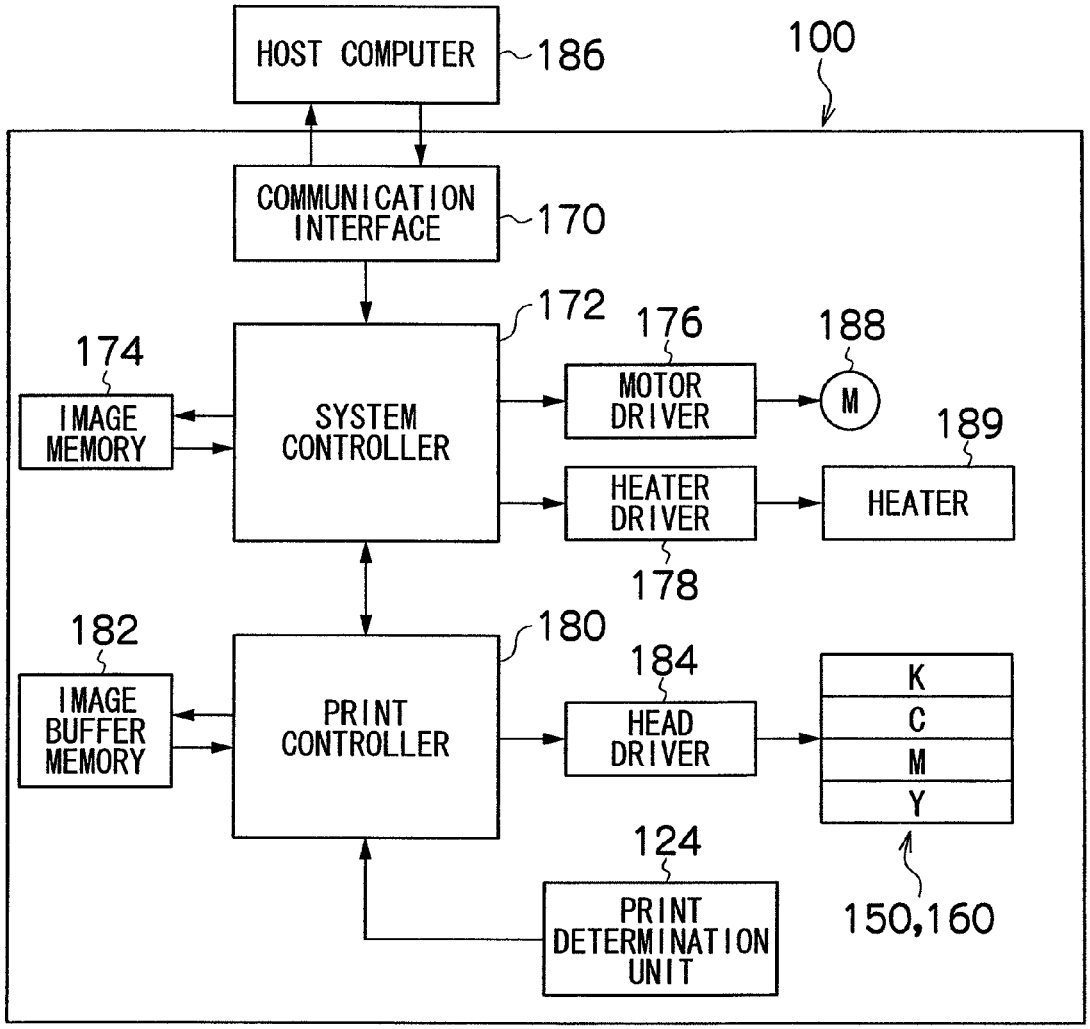
FIG. 11 is a principal block diagram showing the system composition of the inkjet recording apparatus.

FIG. 11 is a principal block diagram showing the system configuration of the inkjet recording apparatus 100. The inkjet recording apparatus 100 comprises a communication interface 170, a system controller 172, an image memory 174, a motor driver 176, a heater driver 178, a print controller 180, an image buffer memory 182, a head driver 184, and the like.

The communication interface 170 is an interface unit for receiving image data sent from a host computer 186. A serial interface or a parallel interface may be used as the communication interface 170. A buffer memory (not shown) may be mounted in this portion in order to increase the communication speed.

The image data sent from the host computer 186 is received by the inkjet recording apparatus 100 through the communication interface 170, and is temporarily stored in the image memory 174. The image memory 174 is a storage device for temporarily storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is a control unit for controlling the various sections, such as the communication interface 170, the image memory 174, the motor driver 176, the heater driver 178, and the like. The system controller 172 is constituted by a central processing unit (CPU) and peripheral circuits thereof, and the like. The system controller 172 controls communications with the host computer 186 and reading and writing from and to the image memory 174, or the like, and generates control signals for controlling the motor 188 of the conveyance system and the heater 189.

The motor driver (drive circuit) 176 drives the motor 188 in accordance with commands from the system controller 172. The heater driver 178 drives the heater 189 of the post-drying unit 142 or other units in accordance with commands from the system controller 172.

The print controller 180 has a signal processing function for performing various tasks, compensations, and other types of processing for generating print control signals from the image data stored in the image memory 174 in accordance with commands from the system controller 172 so as to supply the generated print control signal (dot data) to the head driver 184. Prescribed signal processing is carried out in the print controller 180, and the ejection amounts and the ejection timings of the ink droplets from the print heads 150 and 160 are controlled through the head driver 184, on the basis of the print data. By this means, prescribed dot sizes and dot positions can be achieved. The print controller 180 serves as the dot data creation device, the dot data correction device and the nozzle row position calculation device in the embodiments of the present invention.

The print controller 180 is provided with the image buffer memory 182, and image data, parameters, and other data are temporarily stored in the image buffer memory 182 when the image data is processed in the print controller 180. The aspect shown in FIG. 11 is one in which the image buffer memory 182 accompanies the print controller 180; however, the image memory 174 may also serve as the image buffer memory 182. Also possible is an aspect in which the print controller 180 and the system controller 172 are integrated to form a single processor.

The head driver 184 generates drive signals for driving the heating elements 155, 166 (see FIGS. 10A and 10B) of the heads 150, 160 corresponding to the respective ink colors, on the basis of the dot data supplied from the print controller 180, and the drive signals thus generated are supplied to the heating elements 155, 166. A feedback control system for maintaining constant drive conditions for the heads 150, 160 may be included in the head driver 184.

As described with reference to FIG. 8, the print determination unit 124 is a block including the line sensor, which reads in the image printed on the recording medium 116, performs various signal processing operations, and the like, and determines the print situation (presence/absence of ejection, variation in droplet ejection, and the like), these determination results being supplied to the print controller 180. The print determination unit 124 serves as the abnormal nozzle finding device in the embodiments of the present invention.

Furthermore, according to requirements, the print controller 180 makes various corrections with respect to the print head 50 on the basis of information obtained from the print determination unit 24.

As described above, according to the present invention, if either a large nozzle or a small nozzle is in an abnormal state, then the dot data is corrected so as to use the other nozzle as a corrective nozzle, in such a manner that droplet ejection performed by the corrective nozzle substitutes for droplet ejection that is originally to be performed by the abnormal nozzle. Therefore, even in a region where the droplet deposition rate (the number of droplets deposited per unit surface area) of either the large nozzle or the small nozzle is high, a nozzle having a low droplet deposition rate is selected as the corrective nozzle. Therefore, it is possible to reduce the visibility of banding caused by the abnormal nozzle, while reducing the concentration of load on the corrective nozzle.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a first group of large nozzles which eject large droplets of the liquid for a color;

a second group of small nozzles which eject small droplets of the liquid for the color, the small droplets having volume smaller than the large droplets;

a dot data creation device which creates dot data according to input image data;

a dot data correction device which corrects the dot data if there is an abnormal nozzle in one of the first and second groups, in such a manner that a corrective nozzle is selected from the other of the first and second groups, and droplet ejection performed by the corrective nozzle substitutes for droplet ejection that is originally to be performed by the abnormal nozzle; and a driving device which drives the large and small nozzles to eject the large and small droplets according to the corrected dot data, wherein:

the dot data correction device corrects the dot data if the abnormal nozzle belongs to the second group, in such a manner that a total amount of the liquid ejected by the corrective nozzle is greater than a total amount of the liquid that was originally to be ejected by the abnormal nozzle;

the dot data correction device controls ink-droplet ejection such that the large droplets are ejected and deposited onto a porous surface of paper to form large dots on the paper, and the small droplets are ejected and deposited onto the porous surface of the paper to form small dots on the paper; and wherein the dot data correction device corrects the dot data taking into account that the volume of each of the large droplets is x times the volume of each of the small droplets, and for a volume of each of the large droplets which is equal to a total volume of a first number of the small droplets, a surface area of each of the large dots formed on the paper is smaller than a total surface area of the first number of the small dots formed on the paper, so that the dot data correction device corrects the dot data if the abnormal nozzle belongs to the second group, in such a manner that one large dot substitutes for y small dots, where $1<y<x$.

2. The image forming apparatus as defined in claim 1, wherein if the abnormal nozzle belongs to the second group, the dot data correction device corrects only the dot data for an image region where no large dots were originally to be formed.

3. An image forming apparatus, comprising:

a first group of large nozzles which eject large droplets of liquid for a color;

a second group of small nozzles which eject small droplets of the liquid for color, the small droplets having volume smaller that the large droplets;

a dot data creation device which creates dot data according to input image data;

a dot data correction device which corrects the dot data if there is an abnormal nozzle in one of the first and second groups, in such a manner that a corrective nozzle is selected from the other of the first and second groups, and droplet ejection performed by the corrective nozzle substitutes for droplet ejection that is originally to be performed by the abnormal nozzle; and a driving device which drives the large and small nozzles to eject the large and small droplets according to the corrected dot data, wherein:

the dot data correction device corrects the dot data if the abnormal nozzle belongs to the first group, in such a manner that a total amount of the liquid ejected by the corrective nozzle is less than a total amount of the liquid that was originally to be ejected by the abnormal nozzle;

the dot data correction device controls ink-droplet ejection such that the large droplets are ejected and deposited onto a porous surface of paper to form large dots on the paper, and the small droplets are ejected and deposited onto the porous surface of the paper to form small dots on the paper;

wherein the dot data correction device corrects the dot data taking into account that the volume of each of the large droplets is x times the volume of each of the small droplets, and for a total volume of a first number of the small droplets which is equal to the volume of each of the large droplets, a total surface area of the first number of the small dots formed on the paper is greater than a surface area of each of the large dots formed on the paper, so that the dot data correction device corrects the dot data if the abnormal nozzle belongs to the first group, in such a manner that y small dots substitute for one large dot, where $1<y<x$.

4. The image forming apparatus as defined in claim 3, wherein if the abnormal nozzle belongs to the first group, the dot data correction device corrects only the dot data for an image region where no small dots were originally to be formed.

5. An image forming method for an image forming apparatus having a first group of large nozzles and a second group of small nozzles, the large nozzles ejecting large droplets of liquid for a color, the small nozzles ejecting small droplets of the liquid for the color, the small droplets having volume smaller that the large droplets, the method comprising the steps of:

creating dot data according to input image data;

finding an abnormal nozzle in the large and small nozzles;

correcting the dot data if the abnormal nozzle is found in one of the first and second groups, in such a manner that a corrective nozzle is selected from the other of the first and second groups, and droplet ejection performed by the corrective nozzle substitutes for droplet ejection that is originally to be performed by the abnormal nozzle; and driving the large and small nozzles to eject the large and small droplets according to the corrected dot data, wherein:

in the correcting step, if the abnormal nozzle belongs to the second group, the dot data is corrected in such a manner that a total amount of the liquid ejected by the corrective nozzle is greater than a total amount of the liquid that is originally to be ejected by the abnormal nozzle;

the correcting step controls ink-droplet ejection such that the large droplets are ejected and deposited onto a porous surface of paper to form large dots on the paper, and the small droplets are ejected and deposited onto the porous surface of the paper to form small dots on the paper;

wherein the correcting step corrects the dot data taking into account that the volume of each of the large droplets is x times the volume of each of the small droplets, and for a volume of each of the large droplets which is equal to a total volume of a first number of the small droplets, a surface area of each of the large dots formed on the paper is smaller than a total surface area of the first number of the small dots formed on the paper, so that in the correcting step, if the abnormal nozzle belongs to the second group, the dot data is corrected in such a manner that one large dot substitutes for y small dots, where $1<y<x$.

6. The image forming method as defined in claim 5, wherein in the correcting step, if the abnormal nozzle belongs to the second group, only the dot data for an image region where no large dots were originally to be formed, is corrected.

7. An image forming method for an image forming apparatus having a first group of large nozzles and a second group of small nozzles, the large nozzles ejecting large droplets of liquid for a color, the small nozzles ejecting small droplets of the liquid for the color, the small droplets having volume smaller than the large droplets, the method comprising the steps of:

creating dot data according to input image data;

finding an abnormal nozzle in the large and small nozzles;

correcting the dot data if the abnormal nozzle is found in one of the first and second groups, in such a manner that a corrective nozzle is selected from the other of the first and second groups, and droplet ejection performed by the corrective nozzle substitutes for droplet ejection that is originally to be performed by the abnormal nozzle; and driving the large and small nozzles to eject the large and small droplets according to the corrected dot data, wherein:

in the correcting step, if the abnormal nozzle belongs to the first group, the dot data is corrected in such a manner that a total amount of the liquid ejected by the corrective nozzle is less than a total amount of the liquid that is originally to be ejected by the abnormal nozzle;

the correcting step controls ink-droplet ejection such that the large droplets are ejected and deposited onto a porous surface of paper to form large dots on the paper, and the small droplets are ejected and deposited onto the porous surface of the paper to form small dots on the paper; and wherein the correcting step corrects the dot data taking into account that the volume of each of the large droplets is x times the volume of each of the small droplets, and if a total volume of a first number of the small droplets is equal to the volume of each of the large droplets, then a total surface area of the first number of the small dots formed on the paper is greater than a surface area of each of the large dots formed on the paper, so that in the correcting step, if the abnormal nozzle belongs to the first group, the dot data is corrected in such a manner that y small dots substitute for one large dot, where $1<y<x$.

8. The image forming method as defined in claim 7, wherein in the correcting step, if the abnormal nozzle belongs to the first group, only the dot data for an image region where no small dots were originally to be formed, is corrected.

* * * * *